US008096145B2

(12) United States Patent
Corvino

(10) Patent No.: US 8,096,145 B2
(45) Date of Patent: Jan. 17, 2012

(54) PRECIOUS STONE RING

(76) Inventor: Antonio Corvino, Milan (IT)

( * ) Notice: Subject to any disclaimer, the term of this patent is extended or adjusted under 35 U.S.C. 154(b) by 493 days.

(21) Appl. No.: 12/243,774

(22) Filed: Oct. 1, 2008

(65) Prior Publication Data

US 2009/0199593 A1 Aug. 13, 2009

(30) Foreign Application Priority Data

Feb. 11, 2008 (IT) ..... MI2008A0208

(51) Int. Cl.
*A44C 9/00* (2006.01)
*A44C 17/02* (2006.01)

(52) U.S. Cl. ..... 63/15; 63/31; 63/900

(58) Field of Classification Search ..... 63/900, 63/29.2, 15; D11/26, 92
See application file for complete search history.

(56) References Cited

U.S. PATENT DOCUMENTS

| | | | | | |
|---|---|---|---|---|---|
| 4,052,864 | A | * | 10/1977 | Hofsaess | 63/31 |
| 4,059,971 | A | * | 11/1977 | Shoji | 63/14.1 |
| 4,195,492 | A | * | 4/1980 | Johnson | 63/12 |
| 4,233,777 | A | * | 11/1980 | Inoue | 446/131 |
| 4,424,689 | A | * | 1/1984 | Saito | 63/15.1 |
| 4,912,944 | A | * | 4/1990 | Crosley et al. | 63/29.2 |
| 4,982,581 | A | * | 1/1991 | Furuyama | 63/29.1 |
| D315,698 | S | * | 3/1991 | Abraham | D11/34 |
| 5,115,649 | A | * | 5/1992 | Amber | 63/26 |
| 5,193,360 | A | * | 3/1993 | Lovegrove | 63/15 |
| 5,283,966 | A | * | 2/1994 | Rader et al. | 40/1.5 |
| 5,437,167 | A | * | 8/1995 | Ambar | 63/26 |
| 5,649,434 | A | * | 7/1997 | Itzkowitz | 63/26 |
| 5,664,440 | A | * | 9/1997 | Roemer | 63/15 |
| 5,806,346 | A | * | 9/1998 | Schlinger et al. | 63/40 |
| D421,404 | S | * | 3/2000 | Canale | D11/26 |
| 6,101,843 | A | * | 8/2000 | Nagano | 63/15.4 |
| 6,305,192 | B1 | * | 10/2001 | Indiveri et al. | 63/12 |
| 6,632,168 | B2 | * | 10/2003 | Roberts et al. | 600/9 |
| 6,851,279 | B2 | * | 2/2005 | Hartgrove | 63/31 |
| 7,546,749 | B1 | * | 6/2009 | Biren | 63/15 |
| 2004/0083758 | A1 | * | 5/2004 | Yerushalmi | 63/26 |
| 2006/0272356 | A1 | * | 12/2006 | LeMasters | 63/27 |
| 2007/0084241 | A1 | * | 4/2007 | Kretchmer et al. | 63/29.2 |
| 2007/0089457 | A1 | * | 4/2007 | Katz | 63/26 |

FOREIGN PATENT DOCUMENTS

| | | | | |
|---|---|---|---|---|
| DE | 29913811 | U1 | * | 10/1999 |
| FR | 2882232 | A1 | * | 8/2006 |

* cited by examiner

*Primary Examiner* — Thomas Will
*Assistant Examiner* — Abigail E Morrell
(74) *Attorney, Agent, or Firm* — Hedman & Costigan, P.C.; James V. Costigan

(57) ABSTRACT

A jewelry element, in particular a precious stone ring, including a magnetic device to cause the jewelry element to float with respect to the jewelry element base.

3 Claims, 2 Drawing Sheets

PRECIOUS STONE RING

BACKGROUND OF THE INVENTION

The present invention relates to a jewelry element, in particular a ring including a precious stone.

As is known, a conventional ring comprises a ring setting supporting a precious stone or other ornamental element.

The setting constitutes an integrating portion of the ring-like element which can be engaged on a finger of a hand.

Also known is the fact that, in the jewelry field, the jewelry element designers are continuously searching novel constructions, that is which are novel from an aesthetic and functional standpoint, thereby, in the time, the jewelry element design patterns have been greatly changed.

SUMMARY OF THE INVENTION

Accordingly, the aim of the present invention is to provide a novel precious stone jewelry element construction.

Within the scope of the above mentioned aim, a main object of the invention is to provide a novel setting, for setting a precious stone in a ring or the like.

According to one aspect of the present invention, the above mentioned aim and objects, as well as yet other objects, which will become apparent hereinafter, are achieved by a jewelry element construction, in particular a precious stone ring, characterized in that said jewelry element construction comprises magnetic means of causing the jewelry element construction to float with respect to the jewelry element construction base.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative, but not limitative, example in the accompanying drawings, where.

DESCRIPTION OF THE PREFERRED EMBODIMENTS

Figure 1:
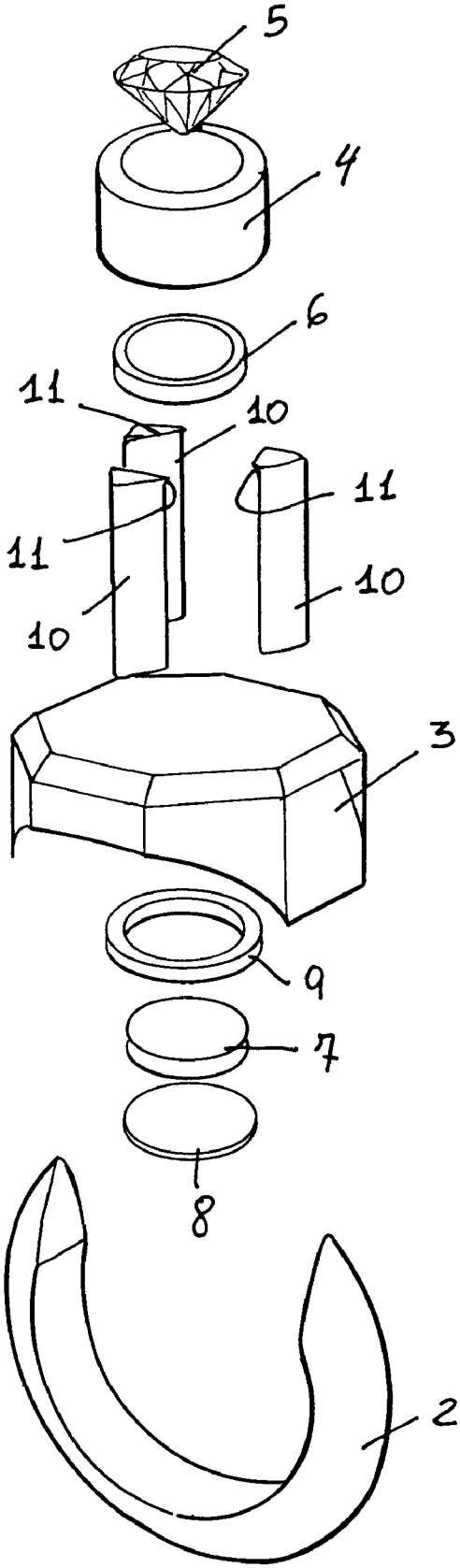
FIG. 1 is an exploded perspective view of the jewelry element or precious stone ring construction according to the present invention.
Figure 2:
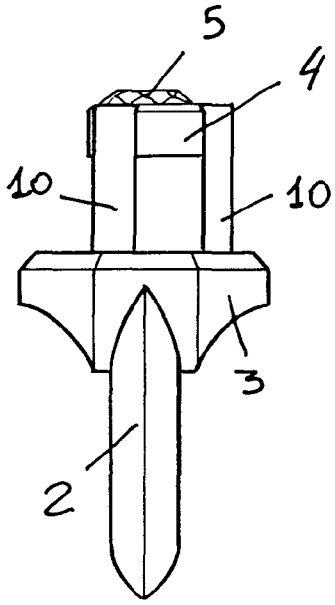
FIG. 2 is a side elevation view of the jewelry element construction according to the invention.
Figure 3:
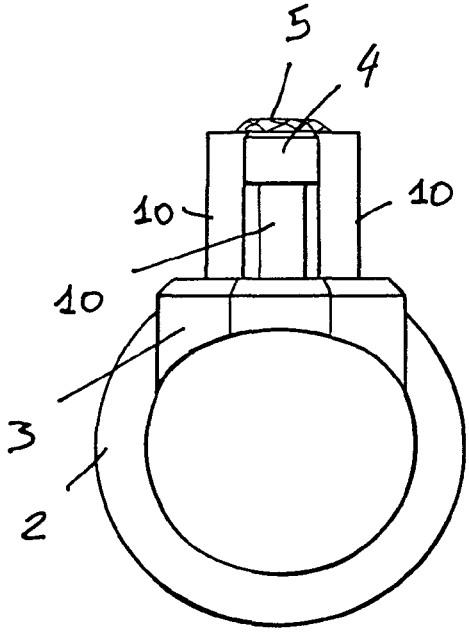
FIG. 3 is a front view of the jewelry element construction according to the invention.
Figure 4:
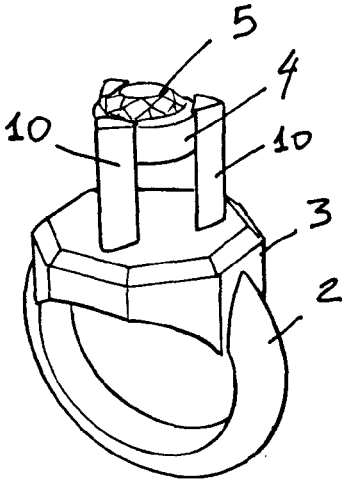
FIG. 4 is a perspective view of the jewelry element construction according to the invention.
Figure 5:
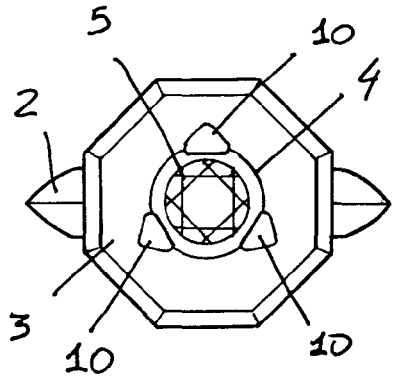
FIG. 5 is a top plan view of the jewelry element construction according to the invention.

With reference to the number references of the above mentioned figures, the jewelry element construction according to the present invention, or precious stone ring, which has been generally indicated by the reference number 1, comprises an annular ring body 2 including a top base portion 3, therefrom extending three upright elements 10 having a substantially triangular cross-section and preferably arranged at the vertex points of an isosceles triangle to define a sliding guide arrangement for a bushing-like setting 4 supporting a diamond, or other precious stone 5, partially embedded into the top of the bushing setting 4.

According to the invention, the bushing setting 4 is coupled to the base 3 by two magnetic mutually repelling discs, which include a first magnet disc 6 and a second magnet disc 7.

The first magnet disc 6 is made rigid with the bottom portion of the bushing setting 4, for example by an adhesive connection (not shown), whereas the second magnet disc 7 is made rigid with the flat under face of the base 3, for example by a further adhesive connection, and through a small plate 8 and a coupling ring element 9. The second magnet disc is arranged between the small plate 8 and the coupling ring element 9.

Thus, the bushing setting 4 is adapted to slide, under a magnetic repelling force, along straight parallel upright elements 10 vertically extending from said top flat surface of said base 3.

As shown, each upright element 10 comprises, at a free end portion thereof, an inward turned edge 11, thereby restraining the setting 4 between the edge 11 and the base 3.

The magnets 6 and 7 are so selected as to repel one another. Thus, the bushing setting 4, and the diamond 5 partially engaged therein, are urged upward, with the edge portion 11 operating as detent elements.

The ring body 2, the base 3, the bushing setting 4, upright elements 10 and small plate 8 and ring element 9 are preferably made of gold or platinum.

It has been found that the invention fully achieves the intended aim and objects.

In fact, the invention has provided an actually novel precious stone ring construction having very pleasant aesthetic properties and novel functional characteristics.

The invention claimed is:

1. A precious stone ring comprising a ring body including a base having a top flat face and a bottom flat face, said top flat face supporting a bushing setting in turn supporting a diamond or precious stone, said diamond or precious stone being partially embedded in a top portion of said bushing setting, said precious stone ring further comprising two magnetically repelling magnet discs, a first magnet disc being rigidly coupled with said bushing setting and the second magnet disc being rigidly coupled with said bottom flat face of said base by a plate and ring element arrangement, wherein said bushing setting is slidably engaged within straight upright elements vertically extending in parallel to one another from said top flat face of said base, each said upright element including a free end portion having an inward turned edge operating as a detent element restraining said bushing setting as said bushing setting is slidably displaced within said uprights from said base top flat face to said inward turned end portions of said uprights.

2. The precious stone ring according to claim 1, wherein said upright elements comprise three upright straight elements arranged at corresponding apex points of an isosceles triangle.

3. The precious stone ring according to claim 1, wherein said ring body, base, bushing setting, upright elements and plate and ring element arrangement are made of gold or platinum.

* * * * *